US010578376B2

(12) United States Patent
Ronacher

(10) Patent No.: US 10,578,376 B2
(45) Date of Patent: Mar. 3, 2020

(54) FIN FOR A PLATE HEAT EXCHANGER AND METHOD FOR PRODUCING SAME

(71) Applicant: Linde Aktiengesellschaft, Munich (DE)

(72) Inventor: Manfred Georg Ronacher, Munich (DE)

(73) Assignee: Linde Aktiengesellschaft, Munich (DE)

( * ) Notice: Subject to any disclaimer, the term of this patent is extended or adjusted under 35 U.S.C. 154(b) by 0 days.

(21) Appl. No.: 15/766,527

(22) PCT Filed: Oct. 6, 2016

(86) PCT No.: PCT/EP2016/001661
§ 371 (c)(1),
(2) Date: Apr. 6, 2018

(87) PCT Pub. No.: WO2017/059959
PCT Pub. Date: Apr. 13, 2017

(65) Prior Publication Data

US 2018/0299210 A1 Oct. 18, 2018

(30) Foreign Application Priority Data

Oct. 8, 2015 (EP) ..... 15002883

(51) Int. Cl.
*F28F 3/02* (2006.01)
*F28D 9/00* (2006.01)
*F28F 21/08* (2006.01)

(52) U.S. Cl.
CPC ..... *F28F 3/025* (2013.01); *F28D 9/0062* (2013.01); *F28F 3/027* (2013.01); *F28F 21/084* (2013.01); *F28F 2275/04* (2013.01)

(58) Field of Classification Search
CPC ..... F28F 1/126; F28F 1/128; F28F 2275/04; F28D 9/0025; B21C 23/10; B21C 23/14
(Continued)

(56) References Cited

U.S. PATENT DOCUMENTS 4,211,276 A * 7/1980 Itoh ..... F28F 13/185 165/133
5,816,320 A * 10/1998 Arnold ..... F28D 1/0535 165/152

(Continued)

FOREIGN PATENT DOCUMENTS

DE 10343107 A1 4/2004
EP 1630896 A1 3/2006

(Continued)

OTHER PUBLICATIONS

Article on Cold Extrusion of Steel found at Total Materia Website, Address: https://www.totalmateria.com/page.aspx?ID=CheckArticle&site=kts&NM=412 Publication date Nov. 2013 (Year: 2013).*

(Continued)

*Primary Examiner* — Jianying C Atkisson
*Assistant Examiner* — Jose O Class-Quinones
(74) *Attorney, Agent, or Firm* — Millen White Zelano & Branigan, PC

(57) ABSTRACT

The present invention relates to a fin (103) for a plate heat exchanger having an angular, wave-shaped structure with wave crests (131) arranged in parallel to one another, wherein a wave crest (131) is connected via a wave flank (132) to another wave crest (131), and wherein the wave crest (131) and the wave flank (132) succeed one another in a first spatial direction (D1), and wherein the wave crest (131) and the wave flank (132) are connected to one another by a sheet edge (134). The wave crests (131) have a flat outer surface (135). According to the invention, the outer radius (R101) of the sheet edges (134) is 0.05 mm to 0.18 mm. A method for manufacturing a fin (103) is also provided, which comprises a pressure-shaping step in which a previously provided bent wave-shaped structure (3) is shaped such that (Continued)

the outer radius (R1) of the sheet edges (34) is reduced (R101).

25 Claims, 8 Drawing Sheets

(58) Field of Classification Search
USPC ..... 165/152, 166; 29/890.03
See application file for complete search history.

(56) References Cited

U.S. PATENT DOCUMENTS 6,415,855 B2 * 7/2002 Gerard ..... F25J 5/002 165/166
6,951,245 B1 * 10/2005 Lehman ..... F25J 3/0409 165/152
7,219,719 B2 * 5/2007 Gerard ..... F28D 9/0062 165/166
8,999,079 B2 * 4/2015 Kamat et al. ..... C22C 21/10 148/417
2004/0188072 A1 9/2004 Gerard
2005/0121181 A1 * 6/2005 Szulman ..... F25J 3/04412 165/166
2006/0183017 A1 8/2006 Kanai
2007/0199686 A1 * 8/2007 Okinotani ..... F28D 1/05383 165/152
2010/0218922 A1 * 9/2010 Paulik ..... B21D 13/045 165/148
2010/0258286 A1 * 10/2010 Yuan ..... F28F 1/126 165/173
2011/0048688 A1 * 3/2011 Leitch ..... F28D 1/0435 165/173
2013/0167584 A1 7/2013 Sunder et al.

FOREIGN PATENT DOCUMENTS

EP 2369284 A2 9/2011
EP 2869013 A1 5/2015
JP 2007-248014 A 9/2007
WO 2012/044288 A1 4/2012

OTHER PUBLICATIONS

International Search Report dated Jan. 31, 2017 issued in corresponding PCT/EP2016/001661 application (3 pages).
English Abstract of JP 2007-248014 A published Sep. 27, 2007.
English Abstract of EP 2369284 A2 published Sep. 28, 2011.
English Abstract of EP 2869013 A1 published May 6, 2015.

* cited by examiner

FIN FOR A PLATE HEAT EXCHANGER AND METHOD FOR PRODUCING SAME

The present invention relates to a fin for a brazed plate heat exchanger and to a method for producing such a fin. The present invention also relates to a brazed plate heat exchanger with such a fin and to a method for producing a brazed plate heat exchanger.

Brazed plate heat exchangers of aluminum are used in numerous installations under a wide variety of pressures and temperatures. For example, they are used for the separation of air, the liquefaction of natural gas or in installations for producing ethylene.

A brazed plate heat exchanger is shown and described for example on page 5 in "The standards of the brazed aluminium plate-fin heat exchanger manufacturers association" ALPEMA, third edition, 2010. An illustration taken from it is represented in FIG. 1 and is described below.

The plate heat exchanger shown there comprises a number of parting sheets 4, which are arranged at a distance from one another and form a multiplicity of passages 1 for the media to be brought into heat exchange with one another. The passages 1 are closed off outwardly by edge bars 8, also referred to as side bars 8, mounted flush on the edge of the parting sheets 4. Arranged within the passages 1 are fins 3 with a wave-shaped structure. The parting sheets 4, fins 3 and edge bars 8 are connected to one another by brazing and thereby from a compact heat exchanger block 10. The entire heat exchanger block 10 is outwardly delimited by outer sheets 5.

For supplying and discharging the heat-exchanging media, semi-cylindrical manifolds 7 with nozzles 6 that serve for the connection of supplying and discharging pipelines are attached by way of inlet and outlet openings 9 of the passages 1. The manifolds 7 are also referred to hereinafter as headers 7. The inlet and outlet openings 9 of the passages 1 are formed by so-called distributor fins 2, which provide a uniform distribution of the media over the entire width of the individual passages 1. The media flow through the passages 1 in the channels formed by the fins 3 and the parting sheets 4.

Such plate heat exchangers are preferably formed from aluminum. The fins 3, parting sheets 4, distributor fins 2, outer sheets 5 and edge bars 8, partly provided with brazing solder, are stacked one on top of the other in the form of a cuboidal block and subsequently brazed in a furnace to form a heat exchanger block 10. Generally, the brazing solder is applied to the parting sheets, and possibly also the fins, on both sides before the brazing. After the brazing in a brazing furnace, the manifolds 7 with nozzles 6 are welded onto the heat exchanger block 10.

The fins are generally produced from thin, planar sheets, which are folded into wave-shaped structures by a press or other tools suitable for the bending-forming operation. FIG. 2 shows an example of a fin 3 formed by a bending-forming operation. This fin has a plurality of wave crests 31 and wave flanks 32, which respectively follow one another in a first spatial direction (D1). As shown in FIG. 11, after the brazing of the heat exchanger block 10 in a brazing furnace, the wave crests 31 of the wave-shaped structure are connected in surface-area contact with the respectively neighboring parting sheets 4 by a brazed connection.

The fins 3 within the passages 1 perform three tasks:

On the one hand, the heat exchanging surface area is increased by the fins. To optimize the heat transfer, the alignment of the wave-shaped structure in neighboring passages is chosen according to the particular application so as to make concurrent flow, cross flow, counter flow or cross-counter flow possible between the neighboring passages.

On the other hand, the fins establish with their wave crests a material-bonding connection among the parting sheets by way of the brazed connections. The wave flanks of the fins absorb the forces that act on the parting sheets as a result of the internal pressure.

Moreover, the fins serve the purpose of dividing the passages into small channels, whereby a uniform distribution of a medium over the entire width of a passage is achieved, and consequently the heat exchange between the media flowing in the neighboring passages is improved.

Due to the boundary conditions that have to be maintained in the forming process of the fin 3, such as inner radii R2 and outer radii R1 of the sheet edges 34 (FIG. 2) at the transition between the respective wave crest 31 and wave flank 32, and the tolerances occurring in the forming process, the fin 3 often has deviations from a desired ideal form with regard to an ideal introduction of force. It has been found that the mechanical strength of a plate heat exchanger is limited as a result. The size of the outer radii R1 is determined by the size of the inner radii R2 and the wall thickness S of the fin.

In order to improve the mechanical strength of a plate heat exchanger with fins, DE 103 43 107 A1 proposes producing the fins from a thick plate, which is either hot-extruded or is produced by a machining process, in order to achieve a rectangular form of wave crests and wave flanks. In this case, further parameters are proposed for the relationship between the thickness of the wave-shaped structure itself and its pitch, i.e. wave length and wave amplitude. A disadvantage of shaping by machining is that, when brazing the heat exchanger block in the brazing furnace, the broken-up microstructure of the fin that is created by the prior machining absorbs an increased amount of brazing solder, as a result of which the strength of the material of the fin is disadvantageously reduced. A fin produced by hot extrusion can only have a very limited width—in the direction D2 that is shown in DE 103 43 107 A1—with a small number of wave crests of about four to five. Moreover, perforated or cut geometries cannot be produced.

To increase the strength of a plate heat exchanger, it is proposed in DE 10 2009 018 247 A1 to provide a passage with a multiplicity of profiles arranged next to one another. By using profiles, it is intended to increase the contact surface area between the parting sheet and the fin. Moreover, profiles have small production tolerances with respect to the desired angular degrees, so that there is a favorable introduction of force. However, producing a plate heat exchanger with profiles as a heat conducting structure in the passages requires increased effort, since the profiles must be placed individually next to one another onto the parting sheets before the brazing.

The object of the present invention is to provide a fin for a plate heat exchanger and a method for producing the same that ensures a high strength of a brazed plate heat exchanger produced with the fin, and consequently can be used for high-pressure applications. The object is also to provide a brazed plate heat exchanger and a method for producing the same.

This object is achieved by a fin with the features as described herein, a brazed plate heat exchanger with the features as described herein, a method for producing a fin as described herein, and a method for producing a plate heat exchanger as described herein.

Accordingly, a fin of aluminum or an aluminum alloy for a plate heat exchanger is provided, having a wave-shaped structure comprising a metal sheet:

with wave crests arranged parallel to one another, a wave crest being connected to a further wave crest by way of a wave flank, a wave crest and a wave flank following one another in a first spatial direction, a wave crest and a wave flank being connected to one another by a sheet edge, each sheet edge having an inner radius and an outer radius, and the wave crests having a planar outer surface area.

According to the invention, the outer radius of the sheet edge is between 0.05 mm and 0.18 mm, preferably between 0.10 mm and 0.15 mm, particularly preferably between 0.10 mm and 0.12 mm. It has been found that, with an outer radius of the sheet edge in the ranges defined above, a fillet weld of brazing solder that allows an optimum introduction of force from the parting sheet into the wave flank forms between the neighboring parting sheet and the wave crest of the fin during the brazing operation in the brazing furnace.

Within the scope of the present invention, the outer radii are determined by a fin portion with a number of wave crests and wave flanks being molded in plastic and subsequently cut open in a plane perpendicular to the wave crests and wave flanks and ground smooth over the surface. With the aid of a 3-point measuring method, the outer radius of the sheet edge between the wave crest and the wave flank is then ascertained. For this purpose, three points are marked on the ground-smooth cross section of the sheet edge at the outer periphery of the sheet edge and their position in relation to one another is ascertained with the aid of a measuring device and a microscope. The outer radius is computationally determined from the ascertained two-dimensional coordinates of the three points.

The inner radius of the sheet edge is preferably 0.2 mm to 0.4 mm, particularly preferably 0.3 mm.

The determination of the inner radius of the sheet edge takes place in the same way as the determination described above of the outer radius of the sheet edge. As a difference from the above method, the measuring points are marked on the inner periphery of the sheet edge.

The wall thickness of the fin, and consequently the wall thickness of the wave crests and the wave flanks, is preferably 0.2 mm to 1.0 mm. The wave crests and the wave flanks within a fin according to the invention preferably have the same wall thickness in the range defined above. In other words, this means that the wave crests and wave flanks of the fin according to the invention preferably form straight wall portions with the same wall thickness, a wave crest respectively being connected to a wave flank by way of a sheet edge curved in a sharp-edged manner.

The fin is preferably formed by performing a forming operation on a planar metal sheet, preferably exclusively by performing a forming operation in two or more forming method steps, preferably on the basis of one or more of the following methods described in DIN 8582.

The final forming method step is preferably a pressure-forming operation, in particular in accordance with DIN 8583, particularly preferably a cold extrusion, in which the outer radii of the sheet edges are brought into the desired range defined above.

The pressure-forming preferably comprises neither bending nor drawing of the fin material. In the case of the fin according to the invention, the final pressure-forming method step, in particular extrusion step, is evident by the microstructure having spherical grains, in particular in the region of the sheet edge at the transition from a wave crest to a wave flank. Preferably over 50%, particularly preferably over 80%, and more preferably over 95%, of the microstructure has structural grains that have a spherical form. The spherical grain structure can be verified in a micrograph of the structure.

In comparison with this, fins that have been produced exclusively by a bending-forming operation or by machining have a microstructure with elongated grain structures in the form of grains of rice. The reason for this is that flat-rolled sheets are used for the bending-forming operation and machining and the sheets already have a microstructure with elongated grains in the form of grains of rice before the bending-forming operation and the machining. These elongated grains may be stretched even further by bending-forming operations.

After the pressure-forming step, the surface of the fin generally has an average roughness $R_a$ of less than 0.4 μm (micrometers); it usually lies in the range from 0.2 μm to 0.4 μm. These surface roughness values are caused by the tool that is used for the pressure-forming according to the invention. The surface roughness values of the surface of the tool acting on the fin, for example a punch, are transferred to the fin during the pressure-forming operation.

The average roughness $R_a$ specifies the average distance of a measuring point—on the surface—from a center line. The center line intersects the actual profile within the reference distance in such a way that the sum of the profile deviations (with respect to the center line) is minimal. The average roughness $R_a$ therefore corresponds to the arithmetic mean of the deviation in absolute terms from the center line. With the aid of the final pressure-forming method step, the average roughness of the surface of the fin is reduced in comparison with the surface of a fin that is produced exclusively by a bending-forming operation, with or without drawing of the material. The average roughness $R_a$ of the surface of fins formed by bending-forming operations is approximately 10 μm.

The fin is preferably formed by a bending-forming step which is followed by a pressure-forming step. With the bending-forming step, preferably in accordance with DIN 8586, a —preferably planar—metal sheet is brought into a wave-shaped structure with at least one wave crest with wave flanks.

A bending-forming operation within the scope of the present invention may comprise purely bending-forming by pivoting about a bending axis and pivoting about a bending axis with a drawing-forming step, in which the sheet is additionally drawn in a spatial direction. This is preferably followed by the pressure-forming method step, preferably cold-extruding method step, in which the outer radius of the sheet edges formed during the bending-forming operation between the wave crest and the wave flank is reduced. The inner radius of the sheet edges preferably does not change during the final pressure-forming method step. The more preferred production method is explained in still more detail below.

In the case of the fin according to the invention, the wave crest and the wave flanks are preferably arranged at right angles to one another, i.e. at an angle of 90° with a deviation of preferably less than 1°, particularly preferably of less than 0.5°. It follows from this that the wave flanks of the fin according to the invention are also arranged parallel to one another. Moreover, the at least one wave crest has a flat, that is to say planar, outer surface area, in order to provide an optimum brazing-connecting area in relation to a parting sheet in a plate heat exchanger. The fin crests preferably have a maximum deviation in their planarity respectively from one sheet edge to the neighboring sheet edge of 0.02 mm.

The fin is preferably of a perforated and/or cut (also referred to as serrated) design, as shown and described on pages 9 and 10 in "The standards of the brazed aluminium plate-fin heat exchanger manufacturers association" ALPEMA, third edition, 2010. The fin advantageously consists of aluminum or an aluminum alloy, particularly preferably of an EN-AW 3003 alloy to the European standard. An aluminum alloy according to the present invention accordingly has aluminum as the main constituent, preferably containing a proportion by mass of aluminum in the overall alloy of at least 90% aluminum, particularly preferably of at least 95% aluminum, and of preferably less than 99.9% aluminum, particularly preferably of less than 99% aluminum. Particularly preferably, the proportion by mass of aluminum in the aluminum alloy lies in the range from 96.8% to 99%. Further alloying constituents may be one or more selected from the group: manganese, iron, copper or silicon. The manganese content of the aluminum alloy in percent by mass preferably lies in the range from 1.0% to 1.5% manganese. The iron content of the aluminum alloy in percent by mass preferably lies at less than 0.7%. The percentage by mass of copper contained in the aluminum alloy is preferably less than 0.2%. The aluminum alloy preferably has a silicon content in percent by mass of less than 0.5%, particularly preferably of less than 0.1%.

The present invention also comprises a brazed plate heat exchanger with a plurality of parting sheets which are arranged in a stack and at a distance from one another and form passages for at least two fluids that come into indirect heat exchange, according to the invention at least one passage having a fin described above or possibly a number of the fins described above. Side bars that are generally arranged between the parting sheets laterally delimit the passages. The parting sheets are generally planar parting sheets of sheet metal, which like the fin are preferably formed from aluminum or an aluminum alloy.

In the case of the plate heat exchanger, the solder layer between the parting sheet and the wave crest of the fin covers with a constant solder layer thickness over 80%, preferably over 90%, particularly preferably over 95%, of the cross section of a wave flank projected perpendicularly onto the parting sheet.

With the fin according to the invention, the above coverage geometries can be achieved, and consequently bursting pressures of the plate heat exchanger of more than 600 bar can be realized when using an EN-AW 3003 aluminum alloy for the fin.

All of the passages of the plate heat exchanger that are intended for the flowing through of the media are preferably provided with one or more of the fins described above. At the same time, in a preferred embodiment the plate heat exchanger otherwise has the same components and the same structure as described at the beginning in relation to FIG. 1.

The plate heat exchanger according to the invention may also be used for a core-in-shell or block-in-kettle heat exchanger arrangement, as described and shown on pages 66 to in "The standards of the brazed aluminum plate-fin heat exchanger manufacturers association" ALPEMA, third edition, 2010.

The components such as outer sheets, parting sheets and side bars of the plate heat exchanger are formed from aluminum or an aluminum alloy, as described in particular on pages 45 and 46 in "The standards of the brazed aluminium plate-fin heat exchanger manufacturers association" ALPEMA, third edition, 2010.

The parting sheets, which may also be referred to as parting plates, preferably have a wall thickness in the range from 1.0 mm to 3.0 mm, particularly preferably from 1.2 to 2.5 mm and more particularly preferably from 1.4 to 1.7 mm. The outer sheets are generally designed with a greater wall thickness than the respective parting sheets within the heat exchanger block. The outer sheets therefore preferably have a wall thickness in the range from 3 to 12 mm, particularly preferably from 5 to 8 mm.

The present patent application also provides a method for producing a fin for a plate heat exchanger that has the following steps:

a) providing a wave-shaped structure of a formed, preferably bent-formed metal sheet, with at least one wave crest with wave flanks, the wave crest and the wave flanks respectively being connected by way of a sheet edge, and the sheet edge having an inner radius and an outer radius, and according to the invention, following step (a), in particular following on after step (a):

b) pressure-forming, preferably cold-extruding, the at least one wave crest with wave flanks of the wave-shaped structure from step (a) in such a way that the outer radius of the sheet edges between the wave crest and the respective wave flank is reduced.

Reducing the outer radius of the sheet edge achieves the effect that an optimum solder layer forms between the respective parting sheet and the wave crest during the brazing operation in the brazing furnace. This achieves the effect that the solder layer between the parting sheet and the wave crest of the fin covers with a constant solder layer thickness preferably over 80%, particularly preferably over 90%, of the cross section of a wave flank projected perpendicularly onto the parting sheet. This ensures that the compressive loads acting on the parting sheets as a result of the media pressure during the operation of the plate heat exchanger are introduced optimally over the entire width of the wave flanks, whereby the maximum mechanical load-bearing capacity of the wave flanks is used. As a result, bursting pressures of over 600 bar can be achieved.

The fin produced according to the invention has a great buckling resistance. As a result, thin-walled fins with wall thicknesses of less than 0.3 mm can be stacked one on top of the other in a greater number than previously in the production process, and consequently the number of passages of a plate heat exchanger and their height can be increased.

The outer radius of the sheet edge, which after a forming step according to step (a) usually lies in a range from 0.2 mm to 1.6 mm, often in a range from 0.4 to 1.4 mm, is reduced in step b) during the pressure-forming operation to an outer radius in the range from preferably 0.05 mm to 1.5 mm, preferably 0.05 mm to 0.90 mm, more particularly preferably 0.05 mm to 0.30 mm, more particularly preferably from 0.05 mm to 0.18 mm, more particularly preferably 0.07 mm to 0.18 mm, more particularly preferably from 0.07 mm to 0.12 mm and more particularly preferably from 0.10 mm to 0.12 mm.

The pressure-forming operation according to step b) is a method for forming the wave-shaped structure provided, a plastic state of at least part of the material being brought about, in particular in such a way that a relocation of material from the wave flanks into the region of the sheet edges is made possible. During the pressure-forming operation according to step (b), a plastic state that makes a grain boundary displacement possible within the material is therefore achieved. The compression loading during the pressure-forming operation may be uniaxial or multiaxial. A pressure-forming operation preferably takes place in accordance with DIN 8583. Particularly preferably, during the pressure-forming operation according to step b), a surface pressing is applied, preferably by a punch of a planar surface, (preferably perpendicularly) from the outside to at least one wave crest, while more preferably the wave flanks adjacent to the wave crest are laterally fixed by a die and more preferably the second and third wave crests adjacent to the wave flanks are supported by a die. In this case, the die may be of a one-part or multi-part form. During the extrusion, which within the scope of the present invention is used particularly preferably as the pressure-forming method, the material of the body is made to flow under a pressure—i.e. plastically deform—that is preferably higher than the proof stress with 0.2% plastic deformation, which is also given in material data sheets as $R_{p0.2}$ [N/mm$^2$]. This proof stress as $R_{p0.2}$ [N/mm$^2$] can be in a tensile test in accordance with ASTM B557M-15. A pressure of at least 80 N/mm$^2$ is therefore preferably applied to the material. In this case, a punch generally presses the body into or possibly through a die.

A cold extrusion, in which no heat is introduced into the material from the outside, is preferably used. This means in other words that the extrusion is carried out at ambient temperature, that is to say generally at temperatures below 50° C., in particular below 40° C. Cold extrusion allows a high dimensional accuracy. Not only a forward extrusion but also a backward extrusion and a transversal extrusion may be used. Any desired combinations of the extrusion methods mentioned are also applicable. In the case of forward extrusion, the material flow is directed in the effective direction of the punch, whereas in the case of rearward extrusion the material flow is directed counter to the effective direction of the punch. In the case of transversal extrusion, the material flow is directed transversely in relation to the effective direction of the punch.

During the pressure-forming operation according to step b), the at least one wave crest and the wave flanks are preferably brought into a right-angled arrangement, i.e. to an angle of 90° with a deviation of preferably less than 1°, particularly preferably of less than 0.5°, in relation to one another, or if a right-angled arrangement already existed before the pressure-forming operation, the wave crest and the wave flanks are kept in their right-angled arrangement. This ensures that the compression loads acting on the parting plates as a result of the media pressure during the operation of the plate heat exchanger are introduced into the wave crests perpendicularly as tensile forces without transversal loads, whereby the maximum tensile strength of the wave flanks can be used. After the bending-forming of a planar metal sheet into the described wave-shaped structure, which is preferably provided in step a), by contrast the wave crest and the wave flanks are not ideally arranged at right angles in relation to one another, but have deviations of several angular degrees—of up to 3°.

During the pressure-forming operation according to step b), the wave-shaped structure is preferably reduced in its height. The reduction in height is preferably in the range from 0.4 mm to 1.2 mm, particularly preferably in the range from 0.8 mm to 1.0 mm. The pitch preferably remains unchanged. In this case, material that is plastified or made flowable during the pressure-forming operation is displaced from the wave flanks and the wave crest into a region of the sheet edge between the wave crest and the wave flank, whereby the outer radius of the sheet edge is reduced.

The wave-shaped structure provided in step a) can be obtained by performing a forming operation on a preferably planar metal sheet by a forming method that is known in the prior art. Accordingly, apart from providing the wave-shaped structure, method step a) also preferably comprises the prior production of the wave-shaped structure by a forming method. These are preferably forming methods in accordance with DIN 8582. The forming of the metal sheet is preferably formed by a bending-forming operation. This may comprise bending with a straight tool movement, a rotating tool movement or a combination of the two movements. In all three of the cases mentioned, the sheet is subjected to a bending load. A bending-forming operation is preferably performed in accordance with DIN 8586.

The production method according to the invention for the fin has the advantage that the wall thickness of the wave crests is scarcely changed in comparison with the wall thickness of the planar metal sheet as a starting material. This is of great importance for the strength of the fin in the brazed assembly with the parting plates of a plate heat exchanger.

With the method according to the present invention, a fin is obtained in which the wall thickness of the flanks is only slightly reduced in comparison with the wall thickness of the planar metal sheet that forms the starting material. The percentage wall thickness reduction is calculated according to the following formula: ((S1-S2)/S1)*100, where S1 is the wall thickness of the planar metal sheet as the starting material and S2 is the wall thickness of the wave flank after the pressure-forming operation according to step (b). The percentage wall thickness reduction is therefore defined as the difference between the wall thickness S2 (depicted in FIG. 9) of the wave flanks after the pressure-forming operation according to step b) and the wall thickness S1 of the planar metal sheet as the starting material (S1 in FIG. 8) divided by the wall thickness S1 of the planar metal sheet as the starting material multiplied by 100 in order to obtain the percentages. In the case of the present invention, this wall thickness reduction is less than 10%, particularly preferably less than 5% and more particularly preferably less than 1%. This is not achievable with the conventional exclusive bending-forming method for a fin. With the exclusive bending-forming method for a fin, the wall thickness reduction is generally at least 20%.

With the method according to the present invention, the wall thickness of the fin in the region of the pressure-formed sheet edge, that is to say in the curved transitional region from a wave crest to a wave flank, is advantageously increased in comparison with the wall thickness of the planar metal sheet as the starting material. The percentage wall thickness increase in the region of the pressure-formed sheet edge is calculated according to the following formula: ((S3-S1)/S1)*100. Here, S3 is the transversal wall thickness S3 (FIG. 9) in the region of the pressure-formed bending edge and S1 (FIG. 8) is the wall thickness of the metal sheet that represents the starting material. This wall thickness increase is therefore defined as the difference between S3 and S1 divided by S1 multiplied by 100 in order to obtain the percentage increase. The wall thickness increase in the region of the pressure-formed sheet edge is preferably over 1%, particularly preferably over 5% and more particularly preferably over 10%. With the conventional bending-forming methods for a fin, a wall thickness increase in the region of the sheet edge is not achievable. With the exclusive bending-forming methods according to the prior art, a reduction of the wall thickness of the fin generally occurs in the region of the bent-formed sheet edge.

With the production method according to the invention for a fin, in the wave-shaped structure that is provided in step a) the wave crest and the wave flank preferably follow one another alternately in a first spatial direction. The first spatial direction preferably coincides with the direction of advance of the sheet during the forming of the sheet into the wave-shaped structure mentioned in step a). During the pressure-forming operation according to step b), the advancement of the wave-shaped structure preferably also takes place in this first spatial direction. Moreover, the direction of advancement of the sheet during the flat-rolling to obtain a planar sheet before the forming into the wave-shaped structure mentioned in step a) preferably coincides with the first spatial direction. This means in other words that the direction of advancement of the sheet during the flat-rolling is particularly preferably the same as the direction of advancement of the sheet during the forming into the wave-shaped structure mentioned in step a) and also the direction of advancement of the wave-shaped structure during the pressure-forming operation according to step b).

The forming, preferably bending-forming, of a sheet into a wave-shaped structure that is mentioned in step a) and the pressure-forming according to step b) are preferably performed in one device or in two or more devices arranged one behind the other. This makes it possible to process a metal sheet from a coil without interrupting the material between the forming operation mentioned in step a) and the pressure-forming operation described in step b). This obviates the need for intermediate storage of the metal sheet structured in a wave-shaped form. It is however also possible within the scope of the invention to subject an already prefabricated metal sheet with a wave-shaped structure to a pressure-forming operation according to step b).

The forming of the metal sheet into the wave-shaped structure according to step a) and the pressure-forming according to step b) are particularly preferably carried out without interrupting the material flow, preferably in the same device, one after the other in time. In this case, preferably first the sheet is formed with at least one wave crest—that is to say one wave crest or for example 2 or 3 wave crests—with respective wave flanks to form the wave-shaped structure, preferably by bending-forming, and then the at least one wave crest with wave flanks is pressure-formed according to step b), preferably extruded, preferably in the same direction of advancement as during the forming operation in step a).

Particularly preferably, a method in which first a single, first wave crest with adjacent wave flanks is formed by performing a forming operation, preferably a bending-forming operation, on the sheet and then this first wave crest with adjacent wave flanks is pressure-formed, before a second wave crest with wave flanks is formed, in particular by a forming operation, preferably a bending-forming operation, with a subsequent pressure-forming operation. In other words, therefore, first a wave, comprising a wave crest and adjacent wave flanks, is pre-formed by a bending-forming operation and directly thereafter pressure-formed before the next wave is formed. An advancement of the sheet may take place between the forming of the first wave according to step a) and the pressure-forming of the first wave according to step b), or no material advancement is provided, and then this takes place between the forming of the first wave and the second wave.

The present invention also provides a method for producing a plate heat exchanger, in which a plurality of parting sheets and fins are arranged alternately one on top of the other in a stack and are brazed to one another in a brazing furnace, in order to obtain a cuboidal heat exchanger block. According to the invention, at least one of the fins is produced by a production method described above. The parting sheets are preferably provided with a solder layer, which is particularly preferably applied to the parting sheets by cladding.

The fin produced according to the invention has a greater buckling resistance than fins that have been folded exclusively by bending-forming methods of the prior art. This allows plates and fins to be stacked up in a higher stack during the production of the plate heat exchanger without fins in the passages being buckled under the weight of the parting plates and fins lying above. With respect to further advantages of the plate heat exchanger produced by the production method, reference is made to the statements above.

The fin according to the present invention can be advantageously used for plate heat exchanges in a wide variety of process stages in air separation installations, petrochemical installations, hydrogen installations, syngas installations or natural gas installations. The fin can be advantageously used for applications in the temperature range of less than 80° C., preferably for cryogenic applications at temperatures in the range from 0° C. to −270° C.

BRIEF DESCRIPTION OF THE DRAWINGS

The invention is explained in more detail below on the basis of exemplary embodiments, in which.

Figure 1:
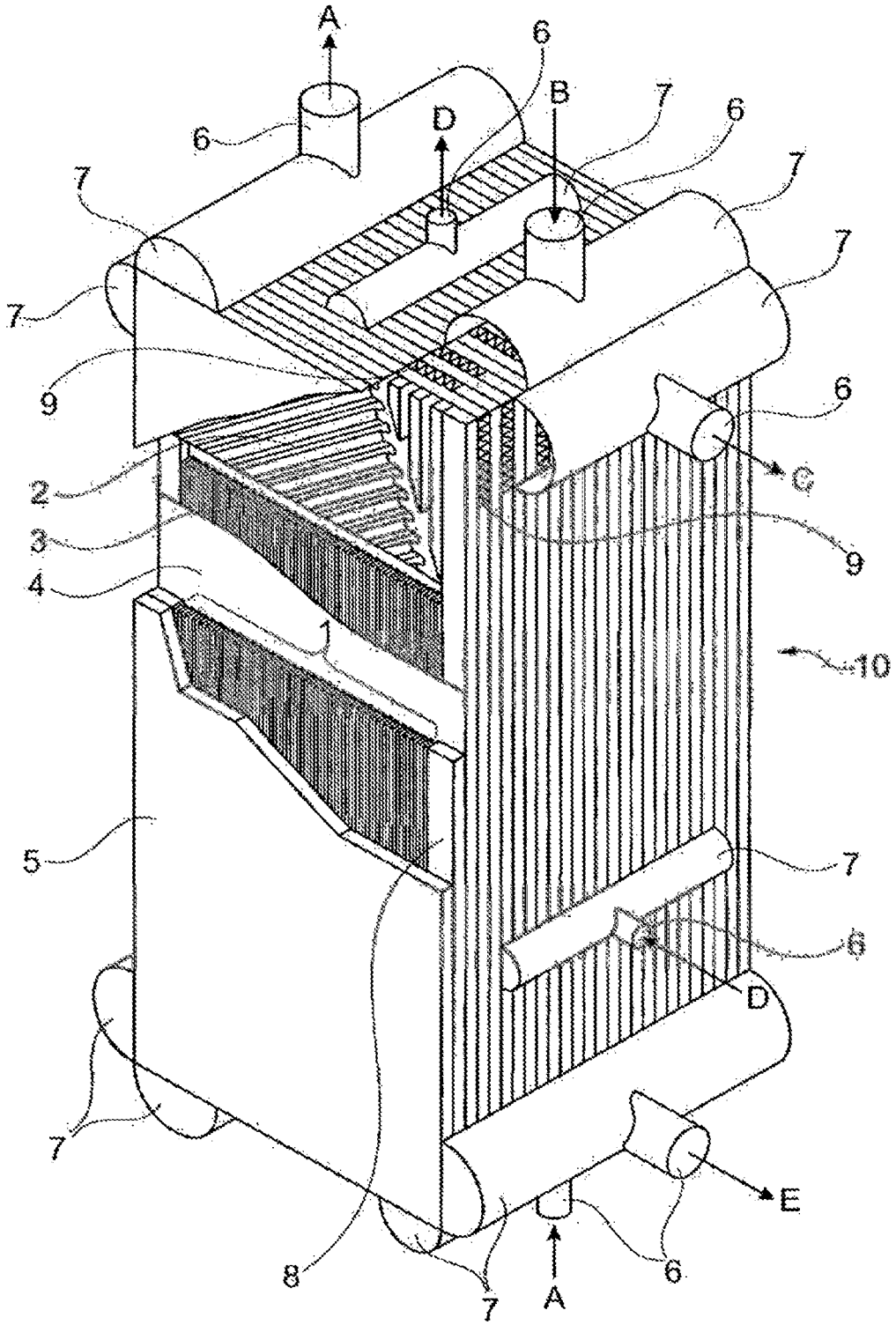
Fig. 1 Prior Art
FIG. 1 shows a plate heat exchanger from page 5 of "The standards of the brazed aluminium plate-fin heat exchanger manufacturers association" ALPEMA, third edition, 2010.

The plate heat exchanger according to FIG. 1 has already been explained in the introductory part of the present description. A preferred embodiment of a plate heat exchanger according to the invention has the same structure as shown in FIG. 1, but is provided with at least one of the fins 103 described above in general or described below with reference to FIGS. 3, 5, 7, 8, 9 and 10.

Figure 2:
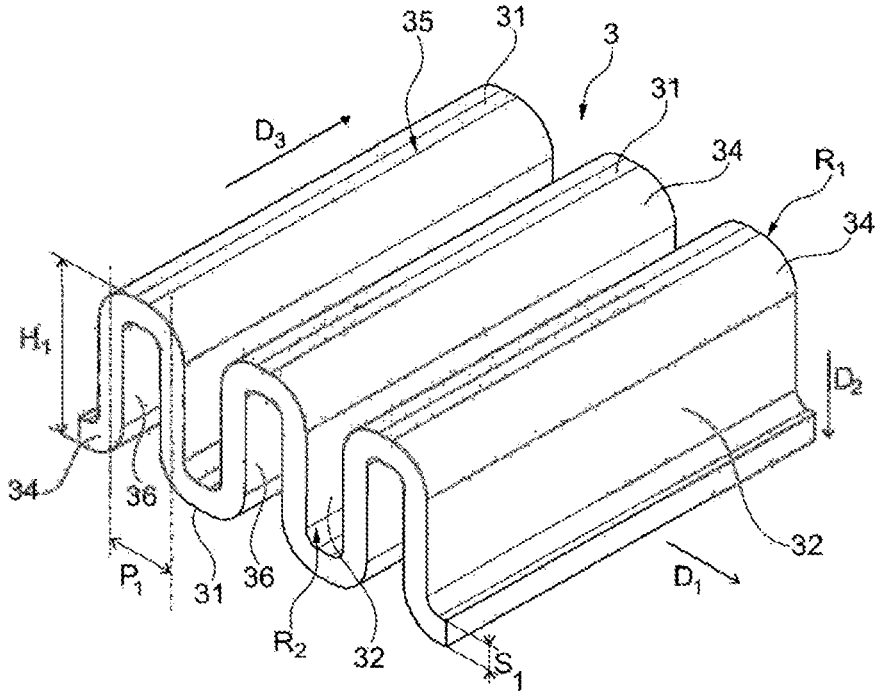
FIG. 2 shows a bent-formed fin 3 in a perspective view.

FIG. 2 shows a fin 3 according to the prior art, which is obtained by bending-forming a planar metal sheet with a wall thickness S1. The fin 3 has a wave-shaped structure with lower and upper wave crests 31, which are connected to one another by way of wave flanks 32. The wave crests 31 and the wave flanks 32 are connected by round bending edges 34, the bending edges 34 respectively having an outer radius R1 and an inner radius R2. The outer radius R1 of the bending edges 34 is determined by the inner radius R2 and the wall thickness S1. In a first spatial direction D1, the wave crest 31 and the wave flank 32 follow one another alternately. The height H1 of the fin 3 extends in a second spatial direction D2, which is aligned perpendicularly to the first spatial direction D1.

Figure 11:
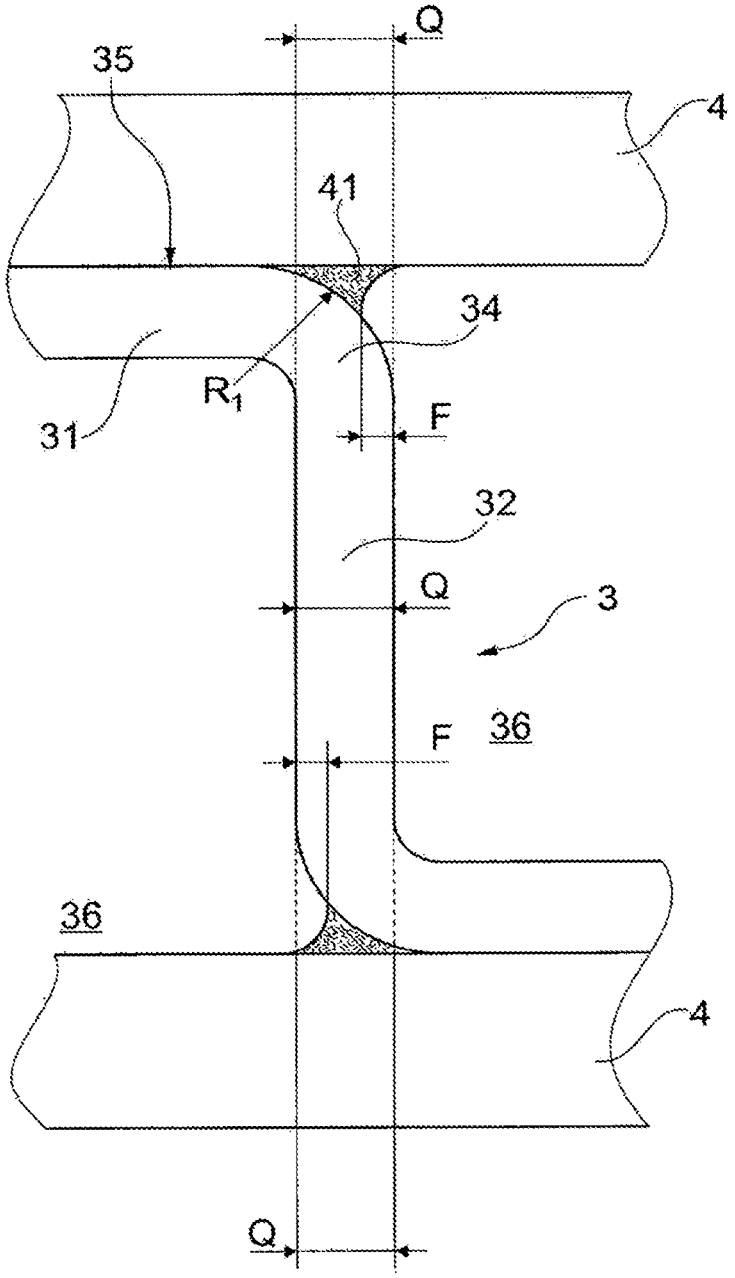
FIG. 11 shows a cross section through a bent-formed fin 3 with brazed parting sheets 4 according to the prior art.

Extending in a third spatial direction D3 are a plurality of channels 36, which are respectively formed by a wave crest 31 with adjacent wave flanks 32 and are delimited in a plate heat exchanger by parting sheets 4, to which the fin 3 is brazed (FIG. 11). During the operation of the plate heat exchanger, the channels 36 are flowed through by a medium in the spatial direction D3 (or in the direction opposite thereto). The third spatial direction D3 is aligned both perpendicularly to the first spatial direction D1 and perpendicularly to the second spatial direction D2.

The pitch of the fin 3 is indicated by the sign "P1". The pitch P1 indicates the length of a portion of the structure of the fin 3 recurring in the first spatial direction D1. Here, this is the distance from the middle of the wall of one wave flank 32 to the middle of the wall of a next-following wave flank 32. The present fin 3 has a relatively small pitch P1 with a relatively great wall thickness S1, and consequently a relatively great outer radius R1. As a result, an only relatively small proportion of the outer surface area 35 in each case of a wave crest 31 is formed as planar.

Figure 3:
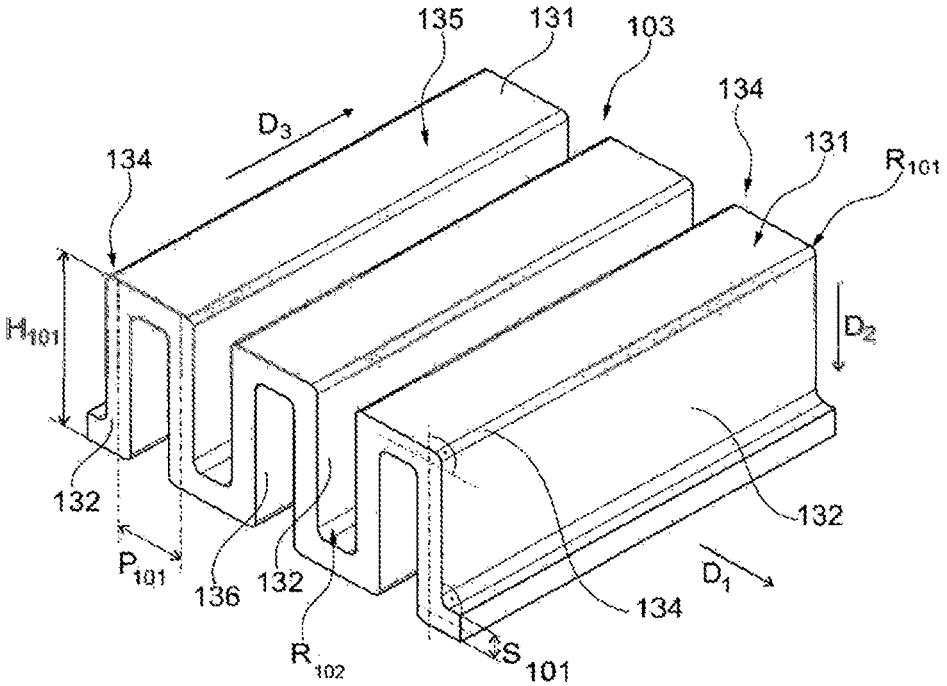
FIG. 3 shows the fin from FIG. 2 after a pressure-forming step according to the present invention.

FIG. 3 shows a fin 103 according to an embodiment of the present invention. This was formed by a production method which comprises a bending-forming step with a subsequent pressure-forming step. The production method is explained in still more detail below with reference to FIG. 8.

The fin 103 according to the invention as shown in FIG. 3 has a sharp-edged wave-shaped structure with wave crests 131 and wave flanks 132, which follow one another alternately in the first spatial direction D1. The lower and upper wave crests 131 are formed as planar and respectively run parallel to one another, i.e. with a maximum deviation of 1°, preferably 0.5°. The wave flanks 132 are respectively arranged at right angles to the wave crests 131. Therefore, the wave flanks 132, which extend in the second spatial direction D2, also respectively run parallel to one another, i.e. with a maximum deviation of 1°, preferably 0.5°. The wave crests 131 are respectively connected to the wave flanks 132 by way of sharp-edged sheet edges 134. The sheet edges 134 respectively have an outer radius R101 and an inner radius R102. With an aluminum alloy to European standard EN-AW-3003, the inner radii are preferably 0.2 mm to 0.4 mm and the outer radii are according to the invention 0.05 mm to 0.18 mm. The pitch is indicated by P101 and is generally 0.9 mm to 5.0 mm. The height H101 of the fin 103 may be 4.0 mm to 12 mm. The wall thickness S101 may lie in the range from 0.2 mm to 1.0 mm. The sharp-edged contour of the sheet edges 134 with outer radii R101 below 0.2 mm is achieved by a pressure-forming step, in which the bent-formed fin 3 from FIG. 2 is in particular compressed in the direction of the second spatial direction D2, and consequently reduced in its height to a height 101. The reduction in height is generally between 0.8 mm and 1.2 mm. As a result, apart from the curved area regions caused by the outer radii R101, the wave crests 131 have planar outer surface areas 135 over the entire width (width extending in the first spatial direction D1) for optimum connection by brazing to likewise planar parting sheets 4 represented in FIGS. 9 and 10.

Figure 8:
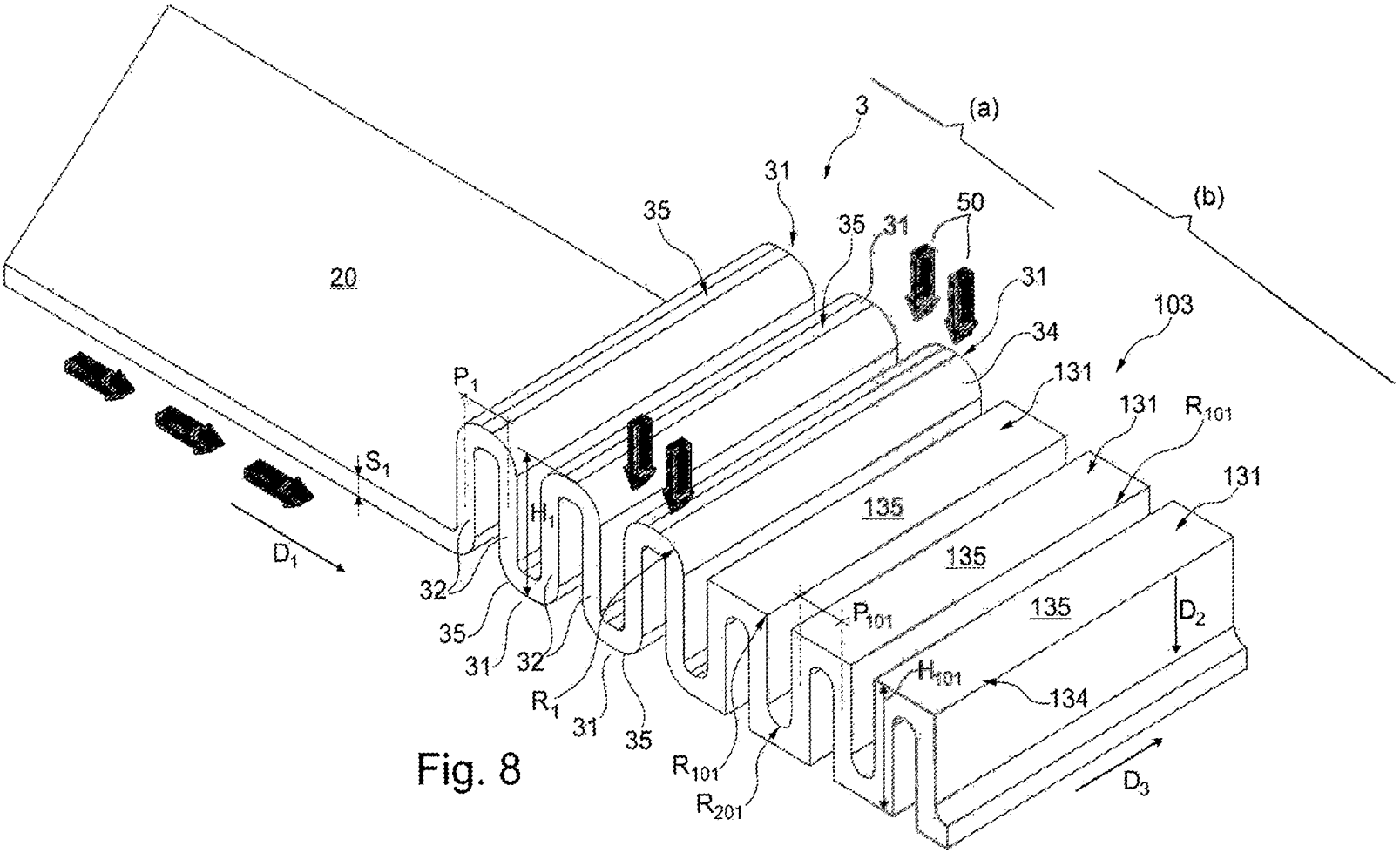
FIG. 8 shows a perspective view of a metal sheet with bent-formed and extruded portions according to a production method according to the invention for a fin.
Figure 12:
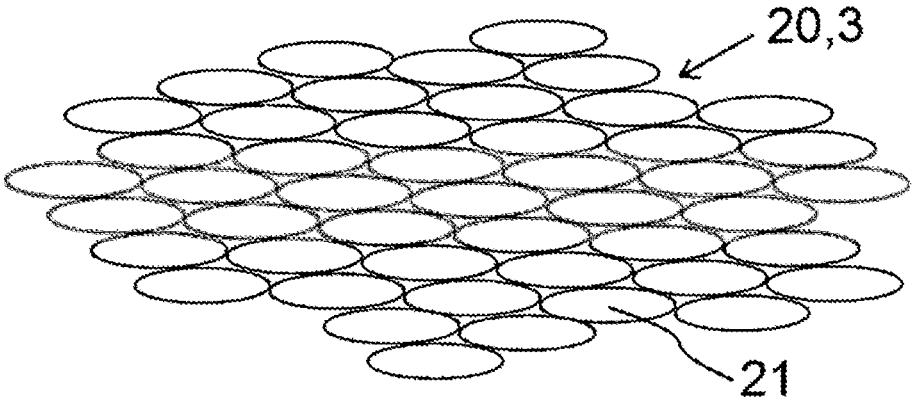
FIG. 12 shows a schematic representation of the microstructure of a metal sheet 20 or of a bent-formed fin 3 after step (a) from FIG. 8.

FIG. 8 shows an embodiment of a production method for the fin 103 shown in FIG. 3. The starting material for the production of the fin 103 according to the invention is a planar, smooth metal sheet 20, for example of an aluminum alloy to European standard EN-AW-3003 with a material thickness or wall thickness S1. The metal sheet 20 is preferably unwound from a sheet coil that is not shown. A planar metal sheet 20 is obtained by flat-rolling a cast bar. The microstructure of the metal sheet 20 therefore has elongated grains 21, as schematically represented in FIG. 12.

In a first step (a) of the production method according to the invention, the planar metal sheet 20 represented in the left portion of the figure is brought by a bending-forming operation into a wave-shaped structure with one, two or more wave crests 31 with respectively adjacent wave flanks 32, as represented in FIG. 2 and described above. For this purpose, preferably one or more tools act on the sheet 20 in a straight movement perpendicularly from below and/or above. A drawing-bending operation is preferred. The direction of advancement D1 of the sheet 20 during the drawing-bending operation that is depicted by arrows coincides with the spatial direction D1 depicted in FIG. 2. The bending-forming operation may also be performed by a rotating movement of the tool or by a combination of straight and rotating tool movements. The bending-forming operation is preferably performed by a method described in DIN 8586. After the bending-forming operation according to step (a), the microstructure (FIG. 12) of the bent-formed fin 3 has structural grains 21 in the form of grains of rice in the same way as the metal sheet 20 that forms the starting material. The structural grains may also have curvatures in the region of the round bending edges 34 of the fin 3, but this is not shown. If the bending-forming operation also includes a drawing-forming component, the grains 21 may be further stretched in comparison with the microstructure present in the sheet 20, i.e. have a greater length, which however is likewise not shown. The direction of advancement during the flat-rolling of the sheet 20 preferably coincides with the spatial direction D1, and consequently with the direction of advancement D1 during the bending-forming operation according to step (a).

The round wave-shaped structure 3 formed in the first step (a), which is shown in the middle portion of the figure of FIG. 8, is then formed further by pressure-forming in a second step (b) of the production method according to the invention. For this purpose, a surface pressing is applied perpendicularly from the outside to the outer surface area 35 of one or more wave crests 31 of the wave-shaped structure, for example by means of a flat punch (illustrated by the arrows 50). during the pressure-forming operation, the respective wave comprising the wave crest 31 and adjacent wave flanks 32, is fixed in a die that is not shown.

The high compression loading has the effect that the metal material is brought into a plastic state, in which it begins to flow. The pressure-forming operation is performed at ambient temperature, i.e. the metal is not externally heated before the pressure-forming or during the pressure-forming operation. It is therefore referred to as cold extrusion. During this cold extrusion, metal is relocated from the curved wave crest 31 and from the adjacent wave flanks 32 into the region of the bending edge 34 by flowing. As a result, the outer radius of the edge 34 is reduced from originally R1 to R101 and the fin is compressed or reduced in its height from H1 to H101.

Figure 13:
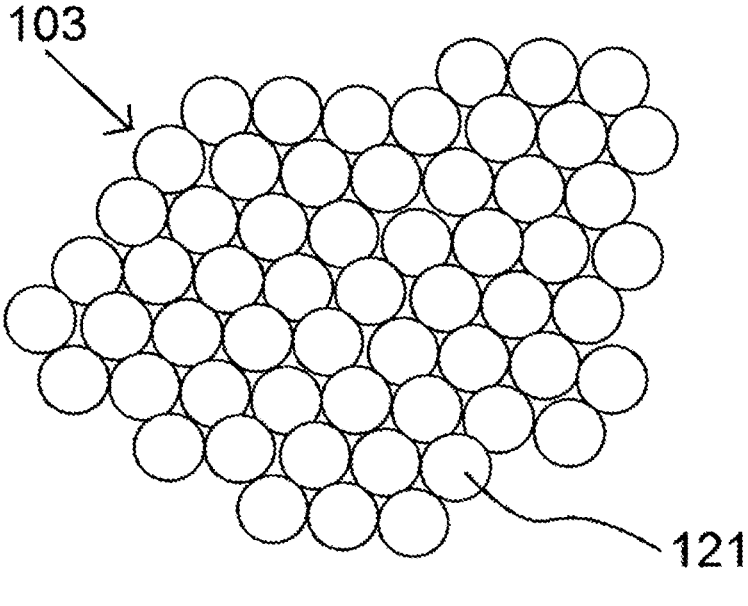
FIG. 13 shows a schematic representation of the microstructure of a fin 103 according to the invention from FIG. 8 after the pressure-forming step (b).

The microstructure of the pressure-formed fin 103 has spherical structural grains 121, as schematically represented in FIG. 13. The fin 103 produced in this way has a surface with an average roughness Ra of less than 0.4 μm.

After the pressure-forming step, the outer radius R101 (back to FIG. 8) is preferably below 0.18 mm, particularly preferably below 0.15 mm. As in the case of the bending-forming operation, the direction of advancement in the case of the pressure-forming operation is in the spatial direction D1. The pressure-forming of the wave-shaped structure is accordingly performed primarily in the spatial direction D2.

In the case of the embodiment shown, the bending-forming step (a) and the pressure-forming step (b) are performed one after the other in time, preferably in the same device without interrupting the material flow.

The result of the production method according to the invention as shown in FIG. 8 is the fin 103 already described above in FIG. 3.

The fin 103 according to the invention is used for producing a plate heat exchanger as described above in relation to FIG. 1. Instead of the fins provided in FIG. 1 with the reference numerals 2 and 3, fins 103 according to FIG. 3 are used.

Parting sheets 4 braze-clad on both sides are arranged alternately with fins 103 and edge bars 8 with exterior outer sheets 5 one on top of the other in a stack and brazed in a brazing furnace. Headers 7 with nozzles 6 are then welded onto the brazed heat exchanger block.

Figure 9:
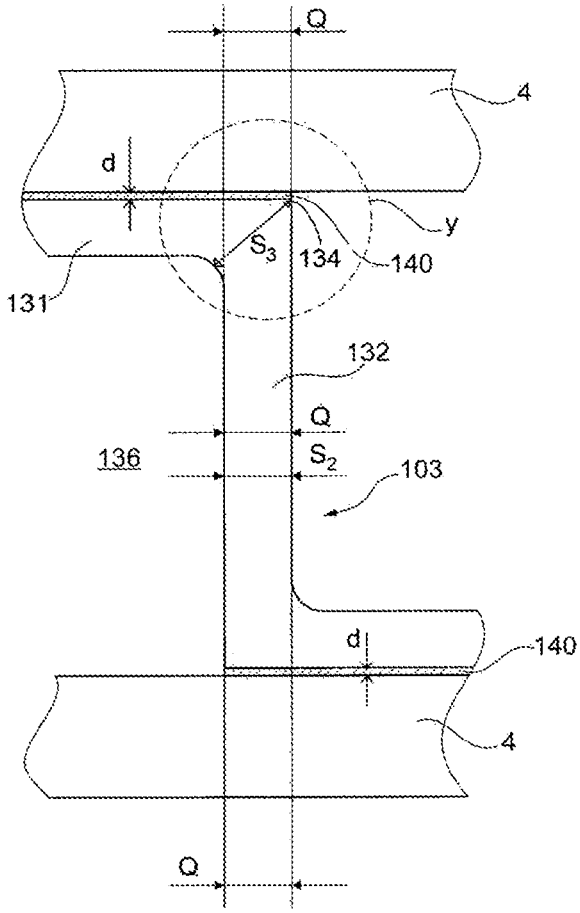
FIG. 9 shows a cross section through a fin 103 according to the invention with brazed parting sheets 4.
Figure 10:
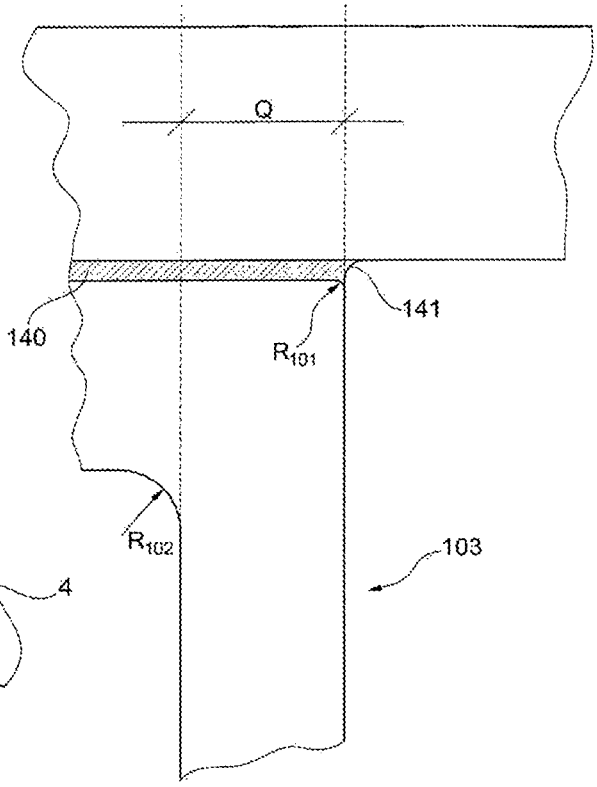
FIG. 10 shows the detail Y from FIG. 9.

FIG. 9 shows a cross section through a fin 103 according to the invention with adjacent, brazed parting sheets 4. FIG. 10 shows a detail Y from FIG. 9. It can be seen from both figures that between the wave crests 131 and the parting sheets 4 there is respectively formed a solder layer 140 with a constant thickness d, which covers 100% of the cross section Q of the adjacent wave flank projected perpendicularly onto the parting sheet 4. As a result, the forces acting on the parting sheets 4 as a result of the internal pressure can be introduced perpendicularly into the wave flanks 132 over their entire cross section Q by way of the solder layer 140. A fillet weld 141 forms with an outer radius R101 in the range according to the invention from 0.05 mm to 0.18 mm outside the projected wave flank cross section Q, whereby the aforementioned optimum solder-layer covering geometry is achieved.

In FIG. 9, the wall thickness of the pressure-formed fin 103 in the region of the flank 132 is indicated by the reference numeral S2. With the method according to the present invention, the wall thickness S2 of the flanks 132 is reduced only slightly in comparison with the wall thickness S1 (FIG. 8) of the planar metal sheet 20, which represents the starting material. The percentage wall thickness reduction is calculated as follows: ((S1-S2)/S1)*100. This is less than 10%, particularly preferably less than 5% and more particularly preferably less than 1%. This is not achievable with the conventional bending-forming methods for a fin. In the case of the exclusively bent-formed fins according to the prior art, the percentage wall thickness reduction is generally at least 20%.

Furthermore, a transversal wall thickness in the region of the pressure-formed sheet edge 134 is depicted in FIG. 9 with the reference numeral S3. With the method according to the present invention, the transversal wall thickness S3 in the region of the sheet edge 134 is increased in comparison with the wall thickness S1 (FIG. 8) of the planar metal sheet 20, which represents the starting material. The percentage wall thickness increase is calculated as follows: ((S3-S1)/S1)*100. This is preferably over 1%, particularly preferably over 5% and more particularly preferably over 10%. This is not achievable with the conventional bending-forming methods for a fin. A reduction of the wall thickness of the fin generally occurs here in the region of an exclusively bent-formed sheet edge.

FIG. 11 shows the brazing of an exclusively bent-formed fin 3 according to FIG. 2, and consequently according to the prior art. In the case of this fin, the fillet weld 41 that forms during the brazing between the bending edge 34 having an outer radius R1 and the parting sheet 4 lies in the region of the projected wave-flank cross section Q. A solder layer with a constant thickness does not form in the projected cross section Q. What is more, the fillet weld 41 does not reach the entire projected cross section Q of the wave flank 32: area regions F of the wave flanks 32 are not connected to the partitions 4 by way of an uninterrupted solder layer. Such a brazing connection has been found to be disadvantageous for the strength of the plate heat exchanger.

Figure 4:
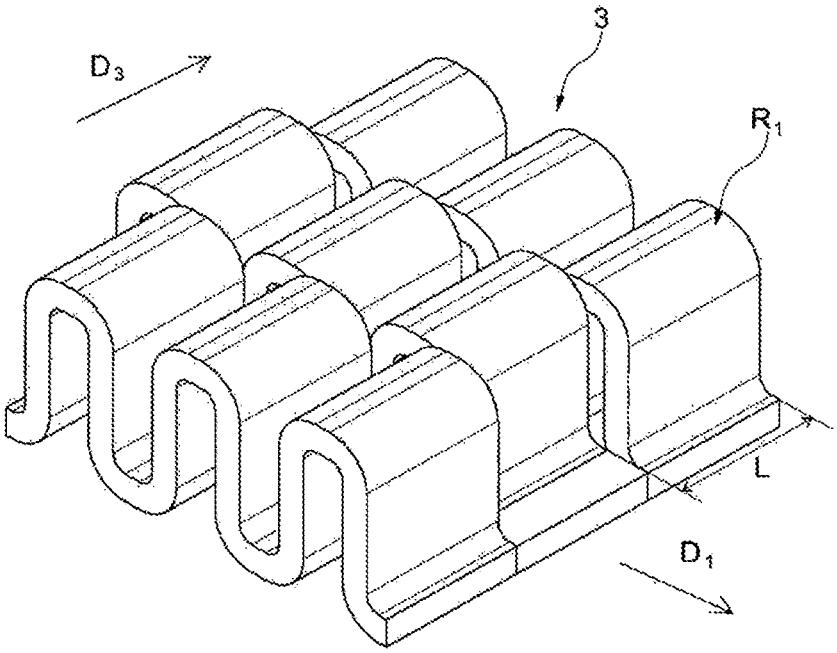
FIG. 4 shows a bent-formed, cut fin 3 in a perspective view.

FIG. 4 shows a bent-formed, cut fin 3 according to step (a) (FIG. 8) of the method according to the invention, and consequently according to the prior art. This fin is produced by drawing-bending a planar metal sheet produced with a superposed, simultaneously occurring cut by individual punches that are offset in relation to one another. The offset is in the direction D1 and alternates over the entire width of the sheet in the direction D3. The cut length L is generally between 1.5 mm and 50 mm. In a subsequent pressure-forming step (b) according to the invention (as shown in FIG. 8), the result of which is represented in FIG. 5, the round wave-shaped structure from FIG. 4 is transformed into a sharp-edged, wave-shaped structure from FIG. 5, in which the outer radius of the bending edge is reduced from R1 to R101, preferably down to 0.05 mm to 0.18 mm.

Figure 6:
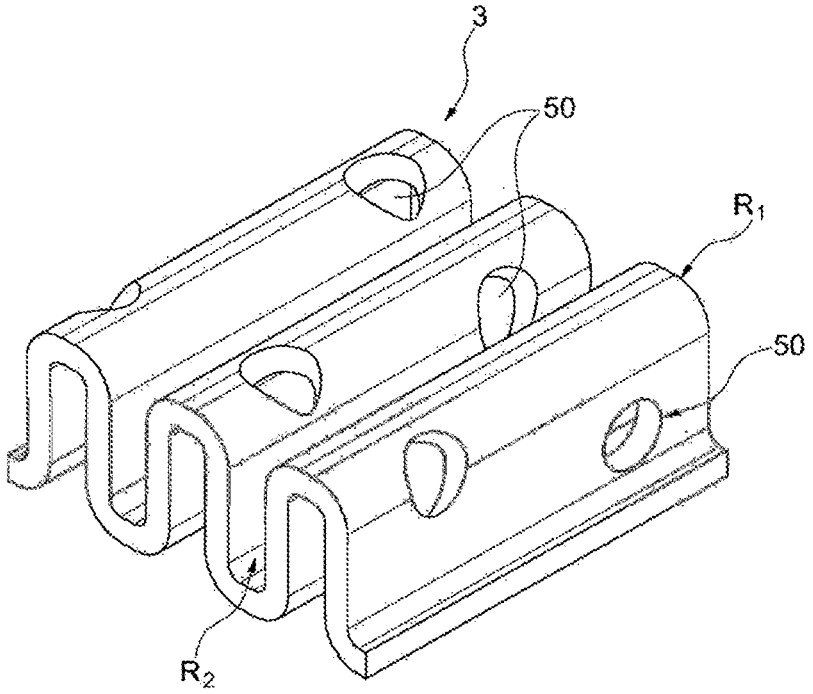
FIG. 6 shows a bent-formed, perforated fin 3 in a perspective view.

FIG. 6 shows a bent-formed, perforated fin 3 after step (a) (FIG. 8) of the method according to the invention, and consequently according to the prior art. The perforations (holes 50) generally have intervals of between 2 mm and 30 mm and diameters in the range of 1 mm and 3 mm. In a subsequent pressure-forming step (b) (as shown in FIG. 8), the result of which is represented in FIG. 7, the round, wave-shaped structure from FIG. 6 is transformed into a sharp-edged structure from FIG. 7, in which the outer radius of the bending edge is reduced from R1 to R101, down to 0.05 mm to 0.18 mm.

Figure 5:
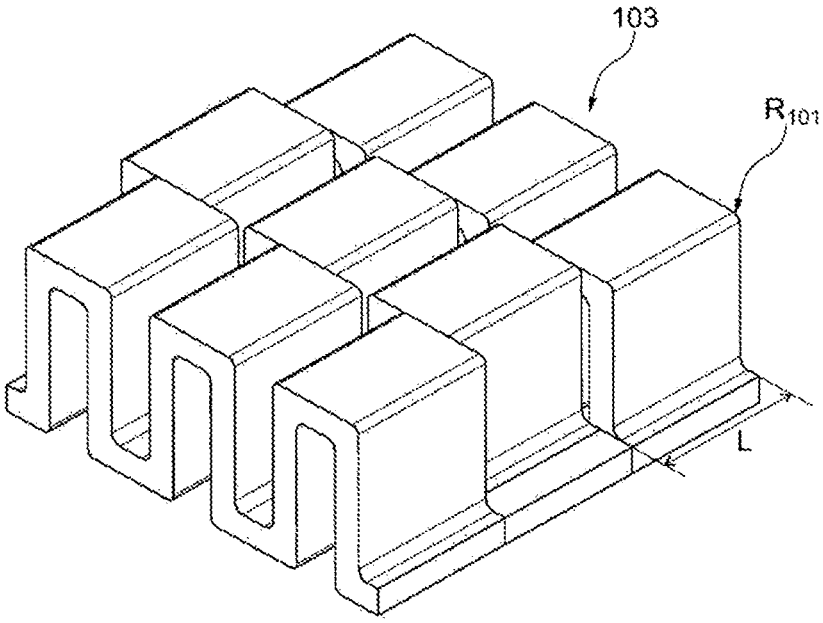
FIG. 5 shows the fin from FIG. 4 after a pressure-forming step according to the present invention.
Figure 7:
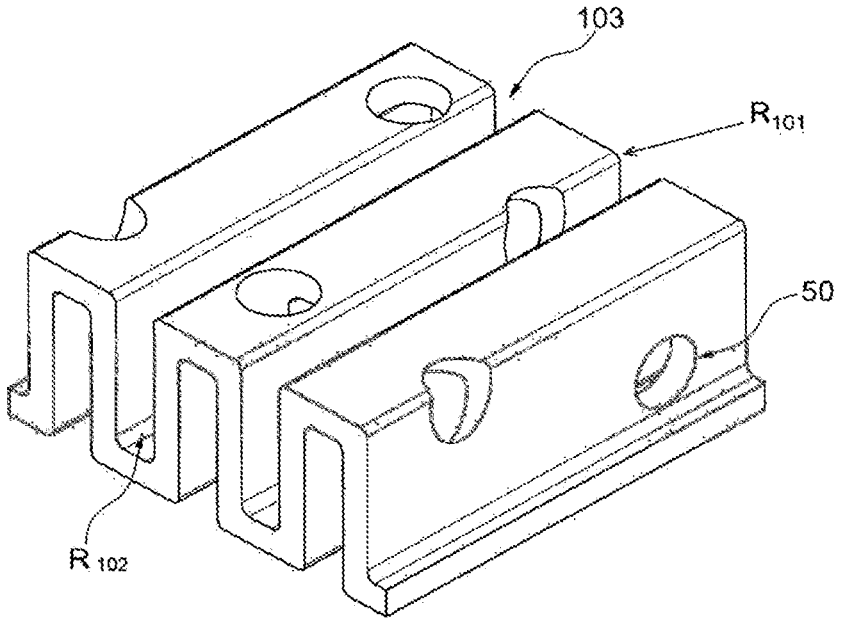
FIG. 7 shows a fin as in FIG. 6 after a pressure-forming step according to the present invention.

The fin 103 according to FIGS. 3, 5 and 7 can be produced by the method according to the invention in a width (in direction D3) of for example 450 mm and a length (in direction D1) of 1500 mm.

List of reference numerals

| | |
|---|---|
| Passage | 1 |
| Distributor fin | 2 |
| Bent-formed fin | 3 |
| Parting sheet | 4 |
| Outer sheet | 5 |
| Nozzle | 6 |
| Manifold (header) | 7 |
| Edge bar (side bar) | 8 |
| Inlet or outlet opening | 9 |
| Heat exchanger block | 10 |
| First spatial direction | D1 |
| Second spatial direction | D2 |
| Third spatial direction | D3 |
| Metal sheet | 20 |
| Structural grain | 21 |
| Wave crest | 31 |
| Wave flank | 32 |
| Bending edge | 34 |

-continued

| List of reference numerals | |
|---|---|
| Outer surface area of wave crest | 35 |
| Channel | 36 |
| Fillet weld | 41 |
| Punch | 50 |
| Outer radius | R1 |
| Inner radius | R2 |
| Height | H1 |
| Wall thickness of metal 20 | S1 |
| Pitch | P1 |
| Area regions | F |
| Pressure-formed fin | 103 |
| Structural grain | 121 |
| Wave crest | 131 |
| Wave flank | 132 |
| Sheet edge | 134 |
| Outer surface area of wave crest | 135 |
| Channel | 136 |
| Pitch | P101 |
| Outer radius | R101 |
| Inner radius | R102 |
| Height | H101 |
| Solder layer | 140 |
| Fillet weld | 141 |
| Wall thickness of wave crest 131 | S101 |
| Wall thickness of wave flank 132 | S2 |
| Transverse wall thickness at sheet edge 134 | S3 |
| Projected cross section | Q |
| Solder layer thickness | d |

The invention claimed is:

1. A fin (103) of aluminum or an aluminum alloy for a plate heat exchanger having a wave-shaped structure comprising a metal sheet:

with wave crests (131) arranged parallel to one another, a wave crest (131) being connected to a further wave crest (131) by a wave flank (132), a wave crest (131) and a wave flank (132) following one another in a first spatial direction (D1), a wave crest (131) and a wave flank (132) being connected to one another by a sheet edge (134), each sheet edge (134) having an inner surface defining an inner radius (R102) and an outer surface defining an outer radius (R101), each of the outer surfaces configured to be directly brazed to a parting sheet of the plate heat exchanger, the wave crests (131) having a planar outer surface area (135) from which the outer surface of the respective sheet edge extend, and the outer radius of the sheet edge (134) is 0.05 mm to 0.18 mm, wherein the inner radius of the sheet edge (134) is 0.2 to 0.4 mm.

2. The fin (103) as claimed in claim 1, wherein the fin (103) has a surface with an average roughness $R_a$ of less than 0.4 μm.

3. The fin (103) as claimed in claim 1, wherein the fin (103) is formed by performing a forming operation on a planar metal sheet with a final pressure-forming step.

4. The fin as claimed in claim 1, wherein the outer radius of the sheet edge is 0.10 mm to 0.15 mm.

5. The fin as claimed in claim 1, wherein the outer radius of the sheet edge is 0.10 mm to 0.12 mm.

6. A method for producing a fin (103) for a plate heat exchanger, said method comprising:

(a) providing a wave-shaped structure (3) of a formed metal sheet with at least one wave crest (31) with wave flanks (32), the wave crest (31) and the wave flanks (32) respectively being connected by a sheet edge (34), and the sheet edge (34) having an inner radius (R2) and an outer radius (R1), (b) pressure-forming the at least one wave crest (31) with wave flanks (32) of the wave-shaped structure (3) from step (a) in such a way that the outer radius (R1) of the sheet edges (34) between the wave crest (31) and the wave flank (32) is reduced (R101).

7. The method as claimed in claim 6, wherein the outer radius (R1) of the sheet edges (34) is reduced in step (b) to an outer radius (R101) in a range from 0.05 mm to 1.5 mm.

8. The method as claimed in claim 6, wherein, during the pressure-forming operation, the wave-shaped structure (3) is reduced in its height (H).

9. The method as claimed in claim 6, wherein the at least one wave crest (31) and the wave flanks (32) are brought into a right-angled arrangement during the pressure-forming operation.

10. The method as claimed in claim 6, wherein a metal sheet (20) is formed into the wave-shaped structure (3) with at least one wave crest (31), and after that the at least one wave crest (31) with adjacent wave flanks (32) is pressure-formed according to step (b).

11. The method as claimed in claim 10, wherein a first wave crest (31) with adjacent wave flanks (32) is formed by performing a forming operation on the sheet (20) and after that the first wave crest (31) with wave flanks (32) is pressure-formed before the second wave crest (31) with wave flanks (32) is formed.

12. The method as claimed in claim 10, wherein a first wave crest with adjacent wave flanks is formed by a bending-forming operation, on the sheet and after that the first wave crest with wave flanks is pressure-formed before the second wave crest with wave flanks is formed.

13. The method as claimed in claim 6, wherein, during the pressure-forming operation according to step b), a surface pressing is applied from the outside to the at least one wave crest (31).

14. A method for producing a plate heat exchanger comprising:

arranging a plurality of parting sheets (4) and fins (3, 103) alternately one on top of the other in a stack, and brazing said parting sheets and fins to one another in a brazing furnace, in order to obtain a cuboidal heat exchanger block, wherein at least one (103) of the fins (3, 103) is manufactured by the method according to claim 6.

15. A brazed plate heat exchanger comprising a plurality of parting sheets (4) arranged in a stack and at a distance from one another and form passages (1) for at least two fluids that come into indirect heat exchange, wherein at least one passage (1) has a fin (103) as claimed in claim 1.

16. The plate heat exchanger as claimed in claim 15, wherein the solder layer (140) between the parting sheet (4) and the wave crest (131) of the fin (103) covers with a constant solder layer thickness (d) over 80% of the cross section (Q) of a wave flank (132) projected perpendicularly (140) onto the parting sheet (4).

17. The plate heat exchanger as claimed in claim 15, wherein the solder layer between the parting sheet and the wave crest of the fin covers with a constant solder layer thickness over 90% of the cross section of a wave flank projected perpendicularly onto the parting sheet.

18. The method as claimed in claim 6, wherein said pressure-forming is performed by extrusion.

19. The method as claimed in claim 6, wherein the pressure-forming is performed by cold-extruding.

20. The method as claimed in claim 6, wherein the outer radius of the sheet edges is reduced in step (b) to an outer radius in a range from 0.05 mm to 0.18 mm.

21. The method as claimed in claim 6, wherein, during the pressure-forming operation, the wave-shaped structure is reduced in its height by 0.4 mm to 1.2 mm.

22. The method as claimed in claim 6, wherein a metal sheet is formed into the wave-shaped structure with one, two or three wave crests by a bending-forming operation, and after that the wave crest(s) with adjacent wave flanks is pressure-formed according to step (b).

23. The method as claimed in claim 6, wherein, during the pressure-forming operation according to step b), a surface pressing is applied by a punch of a planar surface, from the outside to the at least one wave crest while the wave flanks adjacent to the wave crest are laterally fixed by a die.

24. The method as claimed in claim 6, wherein the outer radius of the sheet edges is reduced in step (b) from an outer radius of 0.2 mm to 1.6 mm to an outer radius in a range from 0.05 mm to 0.18 mm.

25. The method as claimed in claim 6, wherein, as a result of the pressure forming (b), the wall thickness in the region of sheet edge is increased by more than 1%.

* * * * *